US005101182A

United States Patent [19]

Babbitt et al.

[11] Patent Number: 5,101,182

[45] Date of Patent: Mar. 31, 1992

[54] DROP-IN MAGNETICALLY TUNABLE MICROSTRIP BANDPASS FILTER

[75] Inventors: Richard W. Babbitt, Fair Haven; Adam Rachlin, Eatontown; Lothar Wandinger, Elberon, all of N.J.

[73] Assignee: The United States of America as represented by the Secretary of the Army, Washington, D.C.

[21] Appl. No.: 637,426

[22] Filed: Jan. 4, 1991

[51] Int. Cl.[5] ..... H01P 1/217

[52] U.S. Cl. ..... 333/205; 333/34

[58] Field of Search ..... 333/202-205, 333/219, 219.2, 235, 161, 34

[56] References Cited

U.S. PATENT DOCUMENTS

| | | | |
|---|---|---|---|
| 3,458,837 | 7/1969 | Ngo | 333/205 |
| 3,539,953 | 11/1970 | Jones | 333/205 X |
| 3,986,149 | 10/1976 | Harris et al. | 333/161 |
| 4,020,429 | 4/1977 | Bickley | 333/205 |

*Primary Examiner*—Eugene R. LaRoche
*Assistant Examiner*—Seung Ham
*Attorney, Agent, or Firm*—Michael Zelenka; William H. Anderson

[57] ABSTRACT

A tunable bandpass filter comprises a flat ferrite body having first and second spaced, coextensive microstrip conductive lines on its upper surface. A winding encircles the ferrite and conductive lines so that a variable d-c current in the winding varies the magnetic permeability of the ferrite and thus the center frequency of the filter.

4 Claims, 1 Drawing Sheet

DROP-IN MAGNETICALLY TUNABLE MICROSTRIP BANDPASS FILTER

GOVERNMENT INTEREST

The invention described herein may be manufactured, used, and licensed by or for the Government for governmental purposes without the payment to us of any royalty thereon.

FIELD OF THE INVENTION

This invention relates to microwave bandpass filters and more specifically relates to a tunable microstrip bandpass filter.

BACKGROUND OF THE INVENTION

Microwave bandpass filters are two port devices which allow the reception of a predetermined band of frequencies and suppress all other frequencies. An ideal filter will accept frequencies within a frequency range which precisely matches the band width and center frequency of the communication spectrum desired. With that range, it will pass signals with almost no dissipation or distortion.

Current parallel coupled microstrip bandpass filters have a fixed center frequency. They employ spaced parallel coupled microstrip lines printed on a planar dielectric. Thus their structure is simple and inexpensive. However, these and other bandpass filters operating above 1GHz have only a fixed center frequency and bandwidth.

A tunable filter has an electronically adjustable center frequency which, when used correctly, will operate within a linear frequency range. Tunability allows the filter to be adjusted to the center frequency of the signal to be received and also allows reception of multiple signals in a multiplexing scheme and is usable in a number of microwave applications.

SUMMARY OF THE INVENTION

The invention provides a means to adjust (e.g. selectively modify) the magnetic permeability of the ferrite of a microstrip band pass filter to permit the filter to be tunable over a limited linear range of center frequencies. Preferably, the adjustment means comprises a winding which encircles the parallel coupled microstrip lines and the underlying ferrite. A d/c current applied to the winding produces a biasing magnetic filed along the along axis of the filter which changes the magnetic permeability of the ferrite, and thus the center frequency of the filter. The d/c current can be controlled in any desired manner, either manually or electronically, in response to the behavior of some other control circuit for the purpose of adjusting the center frequency of the filter.

More specifically, the permeability (u') of the ferrite changes when a magnetic biasing field is applied. This change in permeability results in a change in the velocity of standing waves (Vp) between coupled microstrip pairs, according to the relationship $Vp=c\sqrt{u'_{,}er}$. This change in standing wave velocity results in a change in the frequency of the standing wave, $f=Vp/2\lambda$.

Magnetic biasing is preferably produced by winding a copper coil around the ferrite microstrip and applying a d-c current to the coil. The induced magnetic field within the coil and ferrite changes the permeability (u') of the ferrite. By varying the coil current, one can either increase or decrease the permeability of the ferrite, thus changing the standing wave velocity (Vp) and hence the frequency, ($v=Vp/2\lambda$). This makes it possible to tune the center frequency of a bandpass filter.

Such a tunable microstrip filter is low in cost and can easily be fabricated using existing technology.

BRIEF DESCRIPTION OF THE DRAWINGS

These and other objects, features, and details of the invention will become apparent in light of the ensuing detailed disclosure, and particularly in light of the drawings wherein.

DETAILED DESCRIPTION OF THE PREFERRED EMBODIMENT

Figure 1:
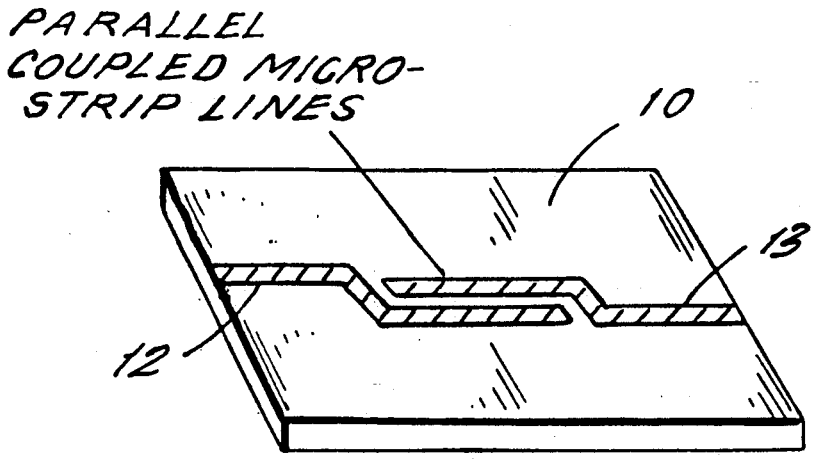
FIG. 1 is a perspective schematic view of a microstrip bandpass filter.

FIG. 1 shows a fixed frequency microstrip filter. This filter is fabricated by printing continuous parallel coupled microstrip lines 12 and 13 upon a dielectric substrate 10. This dielectric substrate 10 is most commonly aluminum ($E_T=9.9$) or Duroid ($E_T\approx 2.2$) which is the name of a trademarked material. As noted previously, an ideal filter of this type only accepts frequencies within a specific frequency range which precisely matches the desired band width and a fixed center frequency of the communication spectrum.

Figure 2:
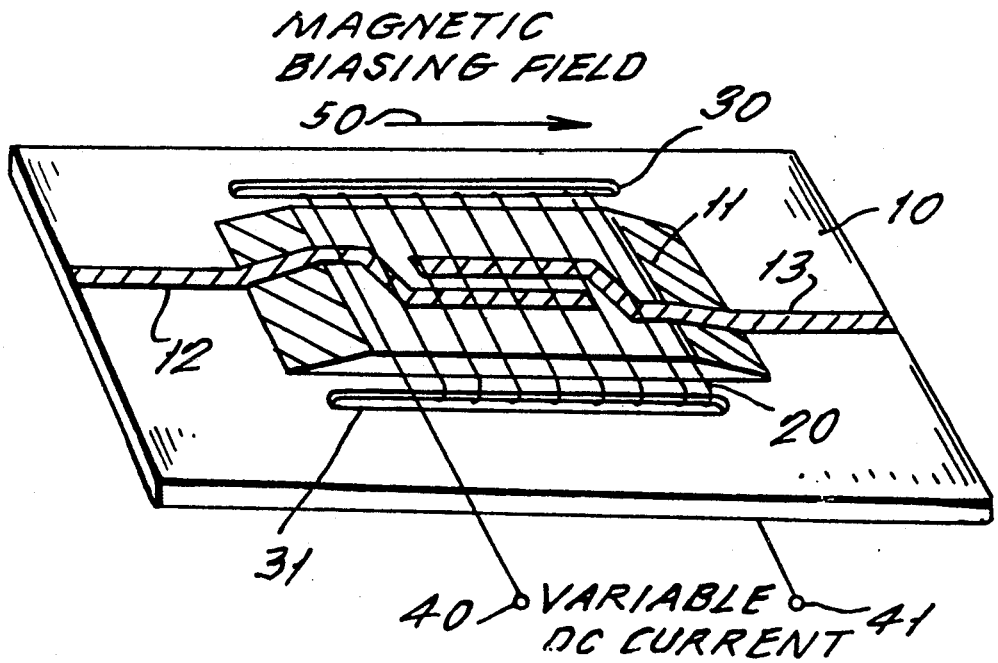
FIG. 2 is a drawing similar to FIG. 1 but shows the addition of a ferrite substrate and a d/c bias for varying the permeability of the ferrite to enable tuning of the filter.

In accordance with the present invention, and as shown in FIG. 2, a thin tapered ferrite substrate 11 is secured to the dielectric substrate 10. The ferrite substrate may be attached to the dielectric substrate by a conductive epoxy. Continuous parallel coupled microstrip lines 12 and 13 are printed upon both ferrite substrate 10 and the dielectric substrate 11. A multiturn copper winding or coil 20 extends around the ferrite substrate 11 and microstrip lines 12 and 13 and extends through slots 30 and 31 in support 10. The terminals 40 and 41 of winding 20 are connected to a source of variable d/c current, as labeled. The production of a d/c current in coil 20 produces a magnetic biasing field 50 within the ferrite. As described above, the induced magnetic biasing field 50 changes the magnetic permeability of the ferrite, and thus the center frequency of the filter may be manipulated due to the resultant change in the velocity of the standing waves between the coupled microstrip lines 12 and 13.

Any desired structure can be employed to generate the magnetic biasing field, for example, permanent magnets or electromagnets which are separate from or integrated with the ferrite 11 can be used. Furthermore, the invention is applicable to microwave devices having different orientations of microstrip lines and ferrite than that shown in FIGS. 1 and 2.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A tunable bandpass filter comprising:

a dielectric substrate;

a magnetically permeable body having at least two tapered ends and a direction of extension between the tapered ends, the magnetically permeable body being attached to the dielectric substrate and covering only a portion of the dielectric substrate;

a plurality of microstrip regions wherein the microstrip regions are spaced from one another and fixed to said magnetically permeable body, the microstrip regions extending from the tapered ends of the magnetically permeable body and on to the dielectric substrate; and a current carrying winding having an axis and being wound around at least portions of said magnetically permeable body and said microstrip regions.

2. The tunable filter of claim 1 wherein the axis of said winding is generally parallel to the direction of extension of said magnetically permeable body.

3. The tunable filer of claim 1 wherein said magnetically permeable body is a ferrite substrate.

4. The tunable filter of claim 1 wherein the dielectric substrate has at least first and second parallel slots therethrough; said winding extending through said first and second slots in said dielectric substrate; said first and second slots extending along adjacent sides of said magnetically permeable body and parallel to the axis of said winding.

* * * * *